US007047593B2

(12) United States Patent
Kitamura et al.

(10) Patent No.: US 7,047,593 B2
(45) Date of Patent: May 23, 2006

(54) VACUUM CLEANER CAPABLE OF COMPRESSING DIRT

(75) Inventors: Hidenori Kitamura, Shiga (JP); Saburo Kajikawa, Kusatsu (JP); Masakazu Onda, Yokaichi (JP); Seiji Ishikawa, Yokaichi (JP); Yasunori Tsuzaki, Yokaichi (JP); Masashi Okushima, Yokaichi (JP); Tetsuharu Nomachi, Yokaichi (JP); Koji Yamamura, Yokaichi (JP); Hirokazu Nagaoka, Yokaichi (JP)

(73) Assignee: Matsushita Electrical Industrial Co., Ltd. (JP)

( * ) Notice: Subject to any disclaimer, the term of this patent is extended or adjusted under 35 U.S.C. 154(b) by 391 days.

(21) Appl. No.: 10/214,203

(22) Filed: Aug. 8, 2002

(65) Prior Publication Data

US 2003/0028994 A1 Feb. 13, 2003

(30) Foreign Application Priority Data

Aug. 8, 2001 (JP) ..... 2001-240795
Dec. 27, 2001 (JP) ..... 2001-396423

(51) Int. Cl.
*A47L 9/10* (2006.01)

(52) U.S. Cl. ..... 15/353; 15/352; 15/327.2; 55/DIG. 3; 55/466; 55/429

(58) Field of Classification Search ..... 15/327.1, 15/327.2, 327.4, 347, 352, 353; 55/DIG. 3, 55/429, 459.1, 428, 466
See application file for complete search history.

(56) References Cited

U.S. PATENT DOCUMENTS

| | | | | |
|---|---|---|---|---|
| 5,254,147 | A * | 10/1993 | Finke | 55/459.1 |
| 6,026,540 | A * | 2/2000 | Wright et al. | 15/353 |
| 6,192,550 | B1 | 2/2001 | Hamada et al. | 15/352 |
| 6,625,845 | B1 * | 9/2003 | Matsumoto et al. | 15/353 |
| 6,745,432 | B1 * | 6/2004 | Wright et al. | 15/353 |

FOREIGN PATENT DOCUMENTS

| | | |
|---|---|---|
| EP | 1136028 | 9/2001 |
| JP | 04370030 | 12/1992 |
| JP | 09253011 | 9/1997 |
| JP | 9253011 | 9/1997 |
| JP | 2000342492 | 12/2000 |
| WO | 02054928 | 7/2002 |

* cited by examiner

*Primary Examiner*—Theresa T. Snider
(74) *Attorney, Agent, or Firm*—Bacon & Thomas PLLC

(57) ABSTRACT

A vacuum cleaner includes a main body having an electric blower for generating a suction air flow, a dirt collecting case for centrifugally separating and collecting dirt, and a compression assembly for compressing dirt collected in the dirt collecting case to reduce a volume thereof. The dirt collecting case has a separation chamber for centrifugally separating dirt from the dirt containing air and a dirt collecting chamber in communication with the separation chamber for accumulating the dirt separated by the separation chamber. The compression assembly has a first air intake member provided in the separation chamber and communicating with the electric blower, a second air intake member provided in the dirt collecting chamber and communicating with the electric blower, a shielding plate for selectively opening the first and the second air intake member and an actuator for driving the shielding plate.

20 Claims, 10 Drawing Sheets

VACUUM CLEANER CAPABLE OF COMPRESSING DIRT

FIELD OF THE INVENTION

The present invention relates to a vacuum cleaner; and, more particularly, to a vacuum cleaner incorporating therein a dirt collecting case (a cyclonic dirt collecting part) which centrifugally separates dirt by way of imparting a cyclonic flow to the suction air.

BACKGROUND OF THE INVENTION

In prior art vacuum cleaners equipped with such cyclonic dirt collectors as described in, e.g., Japanese Laid-Open Publication Nos. 2000-342492 and 1997-253011, dirt entraining air is separated into dirt and clean air by a cyclonic air flow in a cyclonic dirt collector and thus separated dirt then merely piles up at a lower portion of the cyclonic dirt collector.

Therefore, if a large amount of fibroid material, e.g., cotton or the like, is included in the dirt containing air, thus separated dirt tends to occupy a large volume relative to its mass. In a dirt separating process, dirt with a large mass rotates along an outer peripheral side of the cyclonic dirt collector due to the centrifugal force generated by the cyclonic air flow in the cyclonic dirt collector and, therefore, does not considerably reduce the amount of suction air flow which passes through a main filter installed at an inner peripheral side of the cyclonic dirt collector. However, fibrous type dirt having a relatively small mass may not be readily separated from the dirty air in the centrifugal separation process of the cyclonic dirt collector and consequently may be readily stuck on a surface of the main filter, thereby decreasing the amount of suction air flow. In other words, the suction efficiency of a vacuum cleaner can be rapidly deteriorated by the intake of air containing dirt having a relatively small mass.

Such a problem may be addressed by increasing the size of a dirt collector to accommodate a sufficient amount of dirt with a small mass; however, such would not be advantageous because increasing the volume of the dirt collector is not only cumbersome but also against the current trend for the smaller and lighter vacuum cleaners.

SUMMARY OF THE INVENTION

It is, therefore, a primary object of the present invention to provide a vacuum cleaner capable of compressing the dirt that is centrifugally separated by the air flow drawn from a suction head and then is accumulated in a dirt collecting chamber, so that the suction efficiency of the vacuum cleaner is prevented from being prematurely deteriorated to thereby improve the suction efficiency and reduce the frequency of dumping dirt from the dirt collecting chamber.

In accordance with a preferred embodiment of the present invention, there is provided a vacuum cleaner comprising:

a main body having an electric blower for generating a suction air flow;

a dirt collecting case for centrifugally separating dirt, the dirt collecting case being installed at an intake side of the electric blower and communicating with a suction head which draws dirt containing air into the vacuum cleaner; and a member, provided in the dirt collecting case, for compressing dirt collected to reduce a volume thereof.

With such a construction, it is possible to effectively compress dirt accumulated in the dirt collecting case, particularly dirt of a fibroid material and, therefore, premature degradation of the suction performance of the vacuum cleaner due to a small amount of dirt can be effectively prevented. Further, the convenience in using the vacuum cleaner can be enhanced.

BRIEF DESCRIPTION OF THE DRAWINGS

The above and other objects and features of the present invention will become apparent from the following description of preferred embodiments given in conjunction with the accompanying drawings in which.

DETAILED DESCRIPTION OF THE PREFERRED EMBODIMENTS

A first preferred embodiment of the present invention will now be described in detail with reference to FIGS. 1 to 8.

Figure 3:
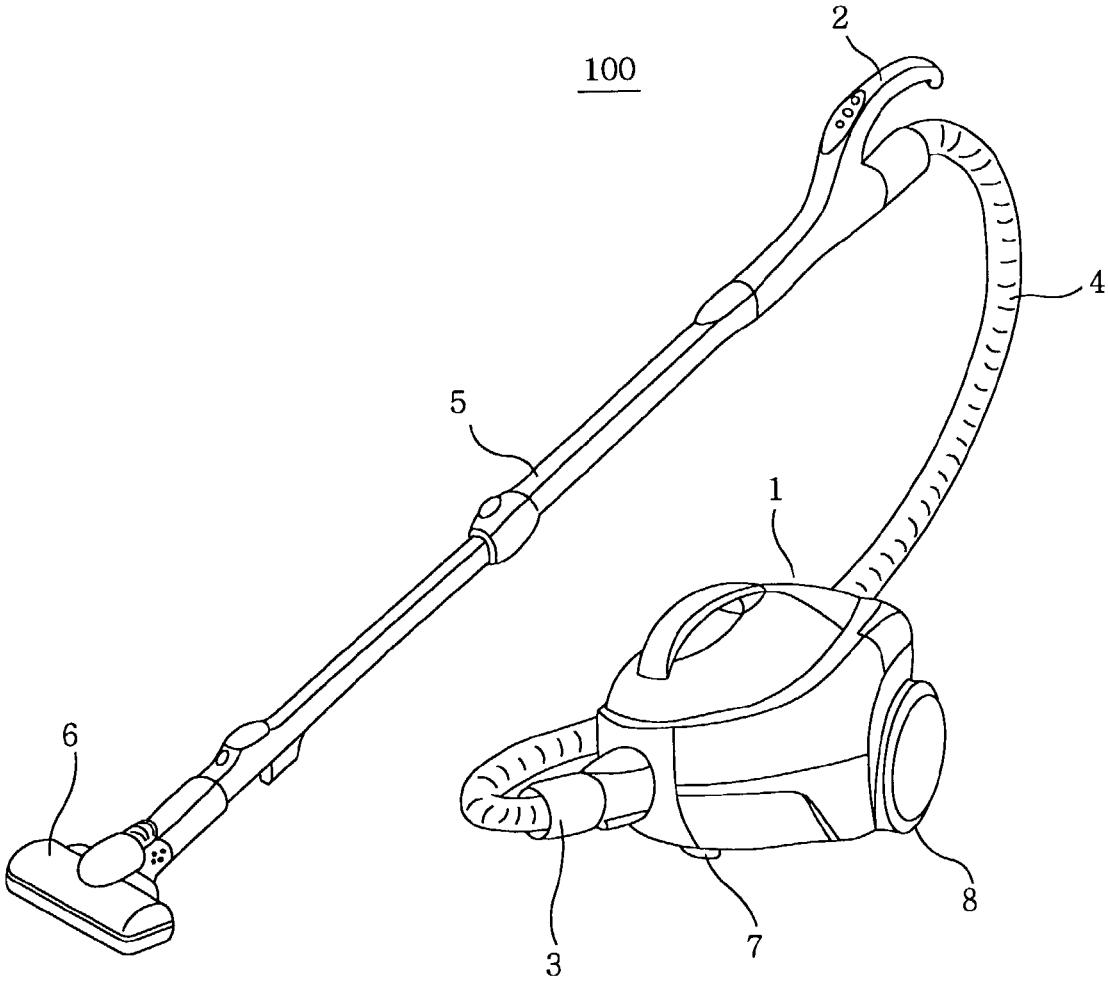
FIG. 3 shows a perspective view of the vacuum cleaner in accordance with the present invention.

Referring to FIG. 3, there is shown a perspective view of a vacuum cleaner 100 in accordance with the present invention. The vacuum cleaner 100 includes a main body (canister body) 1 having a hose joint 3; a hose 4 connected to the main body 1 via the hose joint 3; an extension tube 5 provided with a handle 2 and connected to the hose 4 at one of its ends; and a suction head 6, installed at a free end of the extension tube 5, for the intake of dirt entraining air, whereby the main body 1 is in air flow communication with the suction head 6. The vacuum cleaner 100 further includes a caster 7 at a front bottom portion of the main body 1 and a pair of wheels 8 at both sides of a rear bottom portion thereof.

Figure 1:
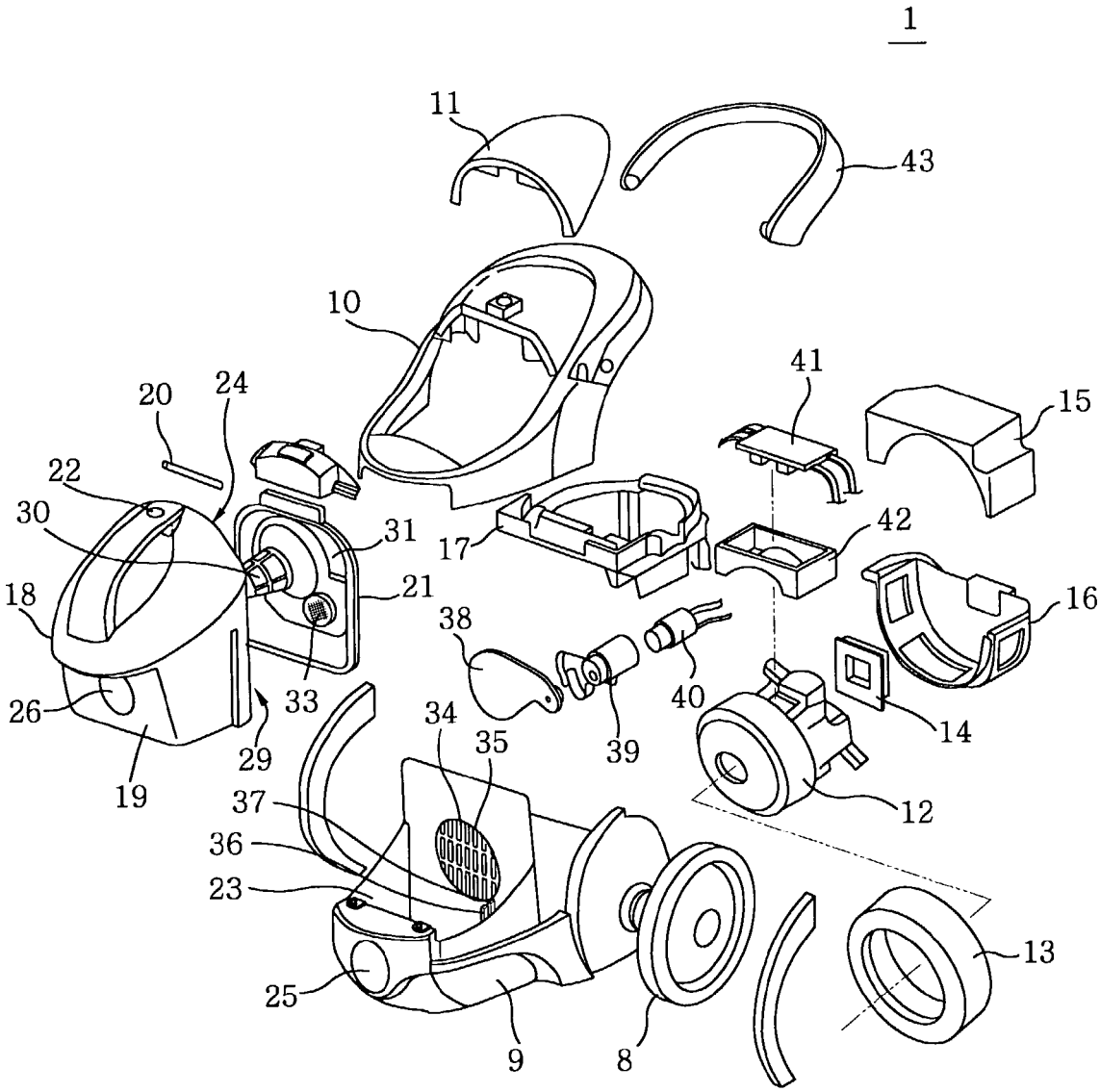
FIG. 1 presents an exploded view of a main body of a vacuum cleaner in accordance with a first preferred embodiment of the present invention.
Figure 2:
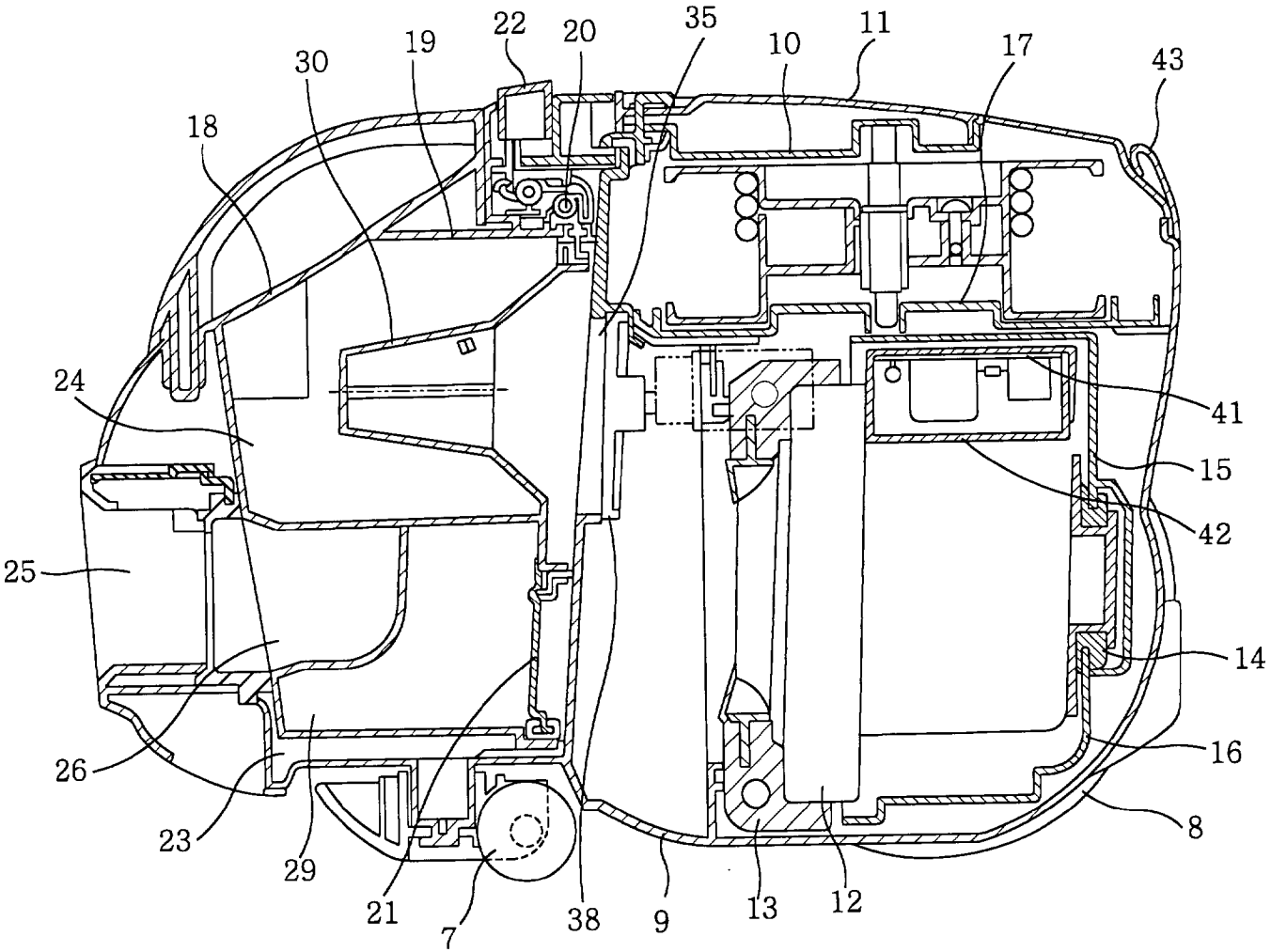
FIG. 2 represents a cross sectional view of the main body of the vacuum cleaner of FIG. 1.

As shown in FIGS. 1 and 2, the main body 1 has a lower body 9, an upper body 10 and a cover 11 defining the outline thereof in conjunction with each other. An electric blower 12 for generating a suction air flow is fixedly installed at the lower body 9 with the help of a middle body 17, the front portion of the electric blower 12 being supported by a first support 13 made of, e.g., rubber and the rear portion thereof being supported by a first and a second motor cover 15 and 16 via a second support 14 made of, e.g., rubber.

A dirt collecting case 18 has a case body 19 and a lid 21 detachably latched to the case body 19 by a shaft 20. To be more specific, the lid 21 is constructed in such a manner that it is released from the case body 19 by pushing a button 22 installed at top of the case body 19. The dirt collecting case 18 is detachably provided at an upstream of the suction air flow generated by the electric blower 12, i.e., at a recess 23 formed at a front portion of the lower body 9.

Figure 4:
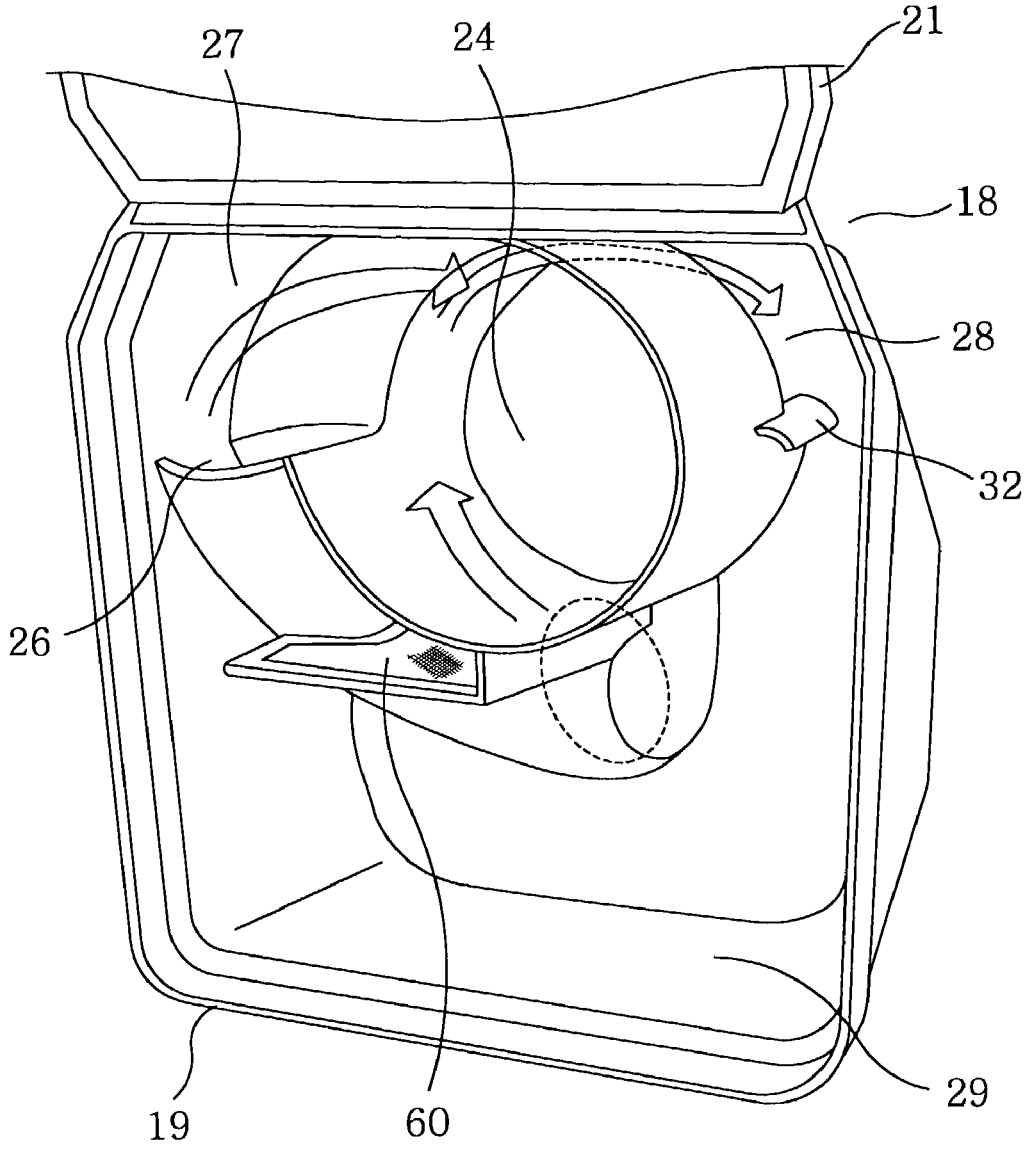
FIG. 4 sets forth a partially cutaway expanded perspective view of a dirt collecting case of the vacuum cleaner of FIG. 1 after opening a lid of the dirt collecting case.
Figure 5:
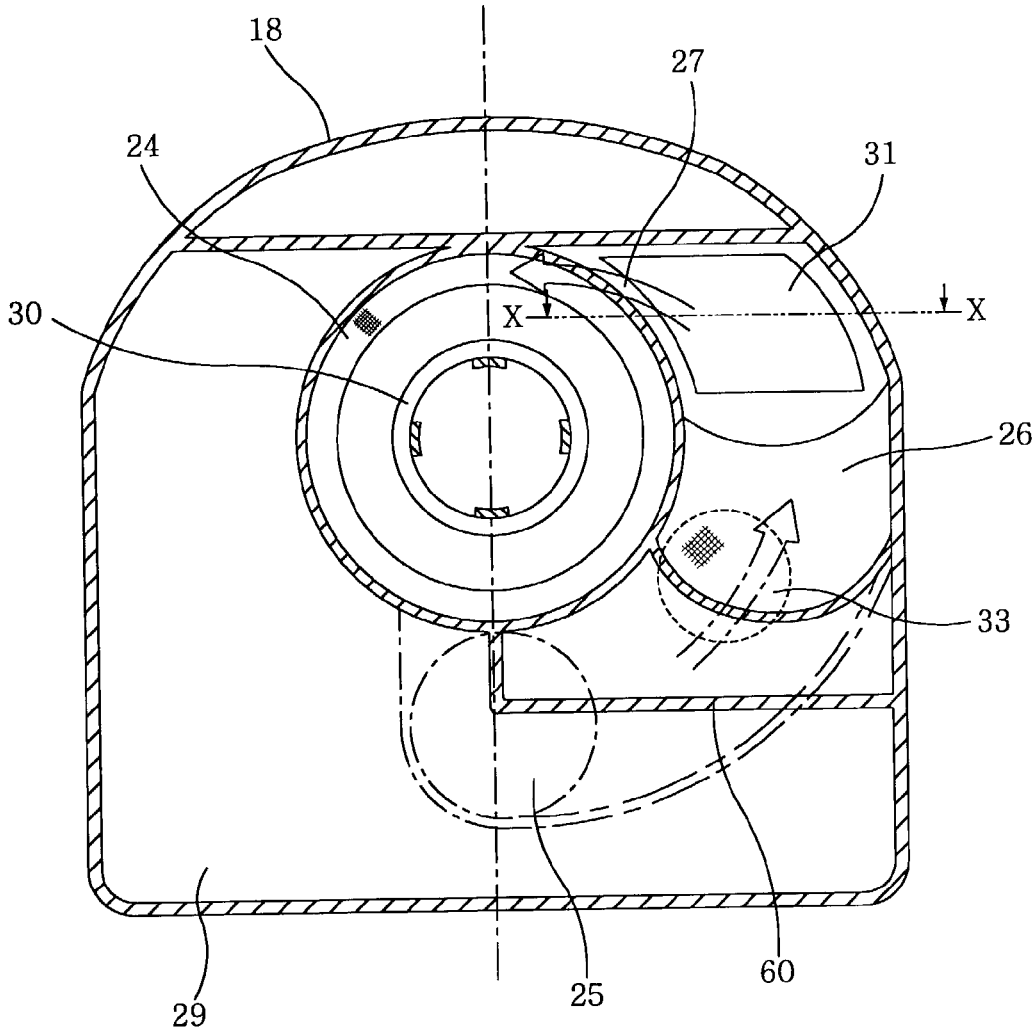
FIG. 5 discloses an expanded cross sectional view of the dirt collecting case of the vacuum cleaner of FIG. 1.

The dirt collecting case 18 is further provided with a separation chamber 24 for centrifugally separating dirt from the dirt entraining air as will be described later, the separation chamber 24 generally being of a hollow cylindrical shape. As shown in FIGS. 4 and 5, the separation chamber 24 is in air flow communication with a dirt conveying conduit 26 for guiding the dirt containing air thereto via a second communication path 27; and also communicates with a dirt collecting chamber 29 for accumulating therein dirt separated from the dirt containing air via a first communication path 28. The dirt conveying conduit 26 is in air flow communication with a suction air inlet 25 of the main body 1 to guide the dirt containing air from the suction air inlet 25 to the separation chamber 24.

Figure 6:
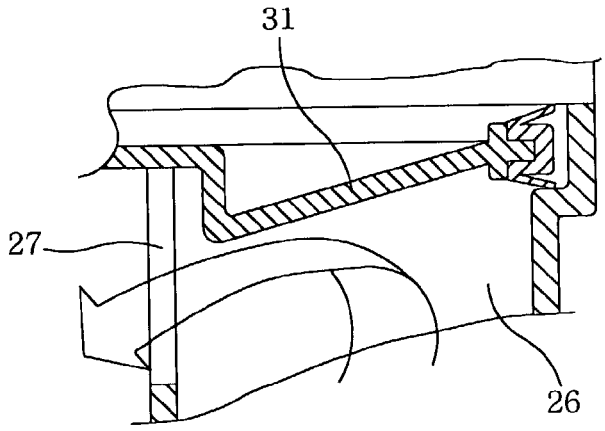
FIG. 6 offers an expanded cross sectional view taken along the line X—X of FIG. 5.
Figure 7:
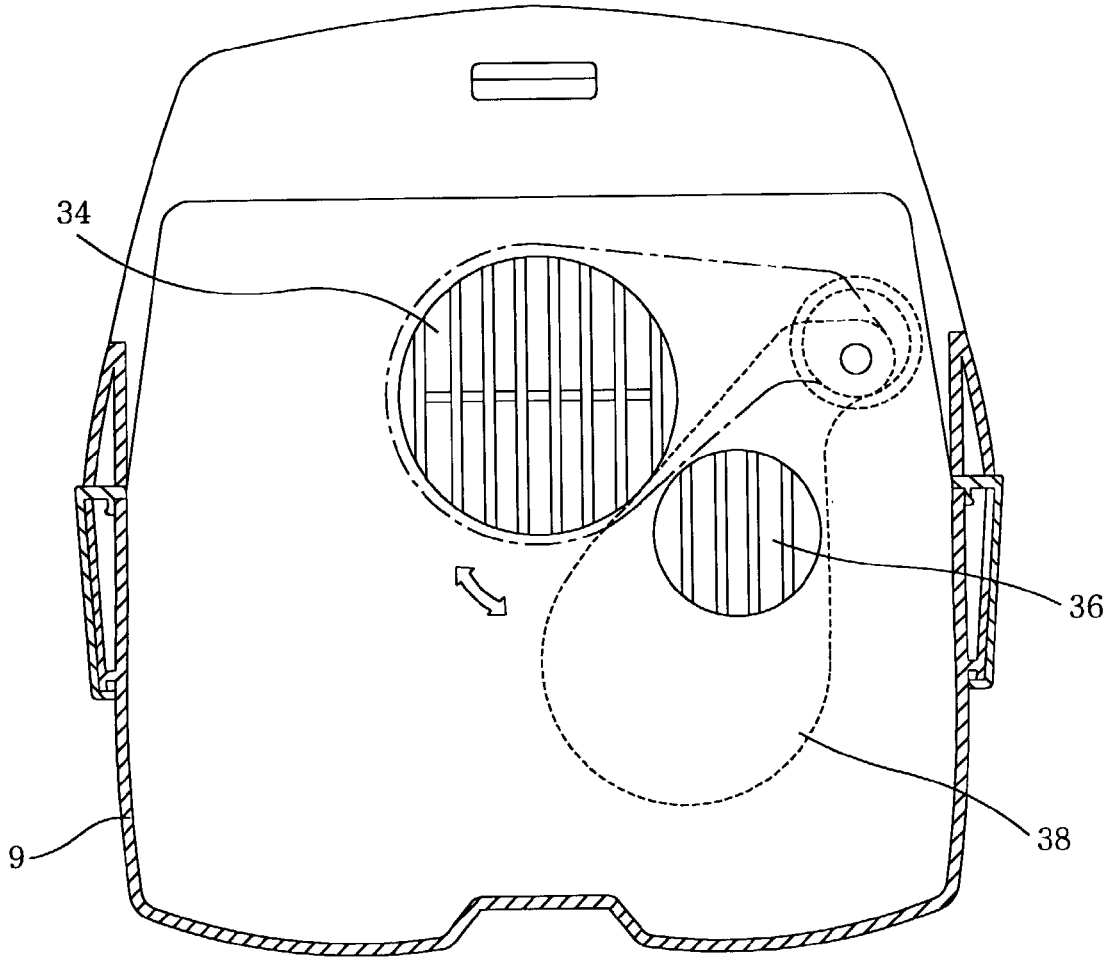
FIG. 7 depicts a cross sectional view of the main body of the vacuum cleaner after removing the dirt collecting case.

The separation chamber 24 is provided with an air suction filter (or a first air intake member) 30 extending from the lid 21 and communicating with an air intake side of the electric blower 12. The second communication path 27 is located close to the air suction filter 30 and the first communication path 28 is disposed at a diagonal position with respect to the second communication path 27. At a position of the lid 21 corresponding to a portion of the dirt conveying conduit 26 next to the second communication path 27, a flow control guide 31 is provided for guiding the suction air flow toward the first communication path 28 along an inner wall of the separation chamber 24, as shown in FIG. 6. Adjacent to the first communication path 28 is installed a backflow barrier 32 for blocking a back stream of air from the dirt collecting chamber 29 to the separation chamber 24.

In addition, the dirt collecting case 18 has compression filter (or a second air intake member) 33, and as shown in FIGS. 4 and 5, the dirt collecting chamber 29 is in air flow communication with the air intake side of the electric blower 12 through a pre-filter 60 and the compression filter 33.

The air suction filter 30 is in air flow communication with the electric blower 12 through a first air suction passage 35 having a first opening portion 34. The compression filter 33 is in air flow communication with the electric blower 12 via a second air suction passage 37 having a second opening portion 36.

The first and the second opening portion 34, 36 respectively constituting the first and the second air suction passage 35, 37 are selectively blocked by a shielding plate 38. The shielding plate 38 is driven by the motor 40 which is mounted in a motor case 39 incorporating therein a reduction gear(not shown). The shielding plate 38 is coupled to the motor 40 via the reaction gear. Therefore, the shielding plate 38 can maintain its position even when the motor 40 is turned off. Normally(i.e., during time periods other than a predetermined time period after turning on the power of the vacuum cleaner 100), the shielding plate 38 is disposed at a position indicated by a dotted line shown in FIG. 7, thereby blocking the second opening portion 36 constituting the second air suction passage 37 while opening the first opening portion 34 constituting the first air suction passage 35. On the other hand, when the vacuum cleaner 100 starts to operate, the shielding plate 38 is placed at a location indicated by one dotted chain line of FIG. 7, thereby blocking the first opening portion 34 constituting the first air suction passage 35 while opening the second opening portion 36 constituting the second air suction passage 37 for a preset time period.

Figure 8:
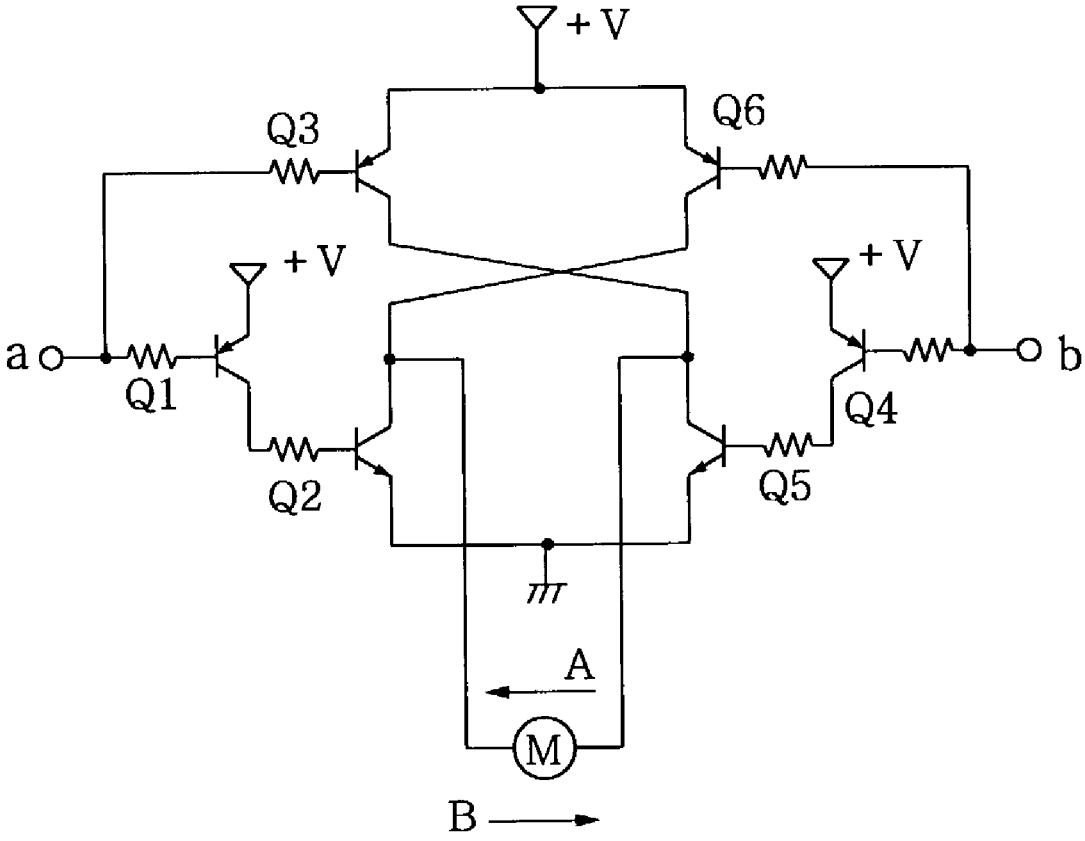
FIG. 8 describes a driving circuit diagram of a motor for driving a shielding plate of the vacuum cleaner.

Referring to FIG. 8, there is shown a circuit diagram of a motor driving circuit having transistors Q1 to Q6. If a logic low(Lo) signal and a logic high(Hi) signal are respectively inputted to input terminals a and b for a preset time, e.g., 1.5 seconds, transistors Q1 to Q3 are turned to be "ON" and transistors Q4 to Q6 are turned to be "OFF". Therefore, a voltage is applied to the motor 40 in a direction indicated by an arrow "A", making the motor 40 rotate in a normal direction, so that the first opening portion 34 constituting the first air suction passage 35 is blocked by the shielding plate 38. On the other hand, when Lo and Hi signals are respectively inputted to the terminals b and a for a predetermined time, e.g., 1.5 seconds, the transistors Q1 to Q3 are turned to be "OFF" and the transistors Q4 to Q6 are turned to be "ON". Therefore, a voltage is applied to the motor 40 in a direction indicated by an arrow "B", allowing the motor 40 to rotate in a reverse direction. Consequently, the shielding plate 38 coupled to the motor 40 can open the first opening portion 34 constituting the first air suction passage 35.

While the first air suction passage 35 is blocked, the electric blower 12 is driven to operate at a maximum power level for the preset time period, e.g., 5 seconds. However, during a traveling time period of the shielding plate 38, e.g., 1.5 seconds, the electric blower 12 is driven to operate at a power level lower than the maximum power level.

Returning to FIGS. 1 and 2, a reference numeral 41 represents a printed circuit board("PCB") including the motor driving circuit; 42, a PCB case for accommodating therein the PCB 41; and 43, a handle.

In assembling, the hose joint 3 of the hose 4 is jointed to the suction air inlet 25 of the main body 1 and the other end of the hose 4 is connected to the suction head 6 via the extension tube 5. In operation, once the power is applied to start operating the vacuum cleaner 100, the electric blower 12 is driven at the operation power level lower than the maximum operation power level, and simultaneously, the Lo and Hi signals are applied to the terminals a and b for the preset time (1.5 seconds). Therefore, the transistors Q1 to Q3 are turned "ON" and the transistors Q4 to Q6 are turned "OFF", so that the motor 40 rotates in the normal direction to rotate the shielding plate 38 to close the first opening portion 34 constituting the first air suction passage 35 and open the second opening portion 36 constituting the second air suction passage 37. After the preset time(1.5 seconds), the first opening portion 34 constituting the first air suction passage 35 is closed by the shielding plate 38; and then the motor 40 is turned "OFF" and the electric blower 12 starts to operate at the maximum operation power for the preset time period(5 seconds).

By operating the electric blower 12 while closing the first opening portion 34 constituting the first air suction passage 35 and opening the second opening portion 36 constituting the second air suction passage 37 as described above, the dirt containing air taken through the suction air inlet 25 is drawn to the electric blower 12, after passing through the dirt conveying conduit 26, the second communication path 27, the separation chamber 24, the first communication path 28, the dirt collecting chamber 29, the pre-filter 60, the compression filter 33, and the second air suction passage 37 having the second opening portion 36 in that order.

Thus generated air stream can be used in effectively compressing dirt accumulated in the dirt collecting chamber 29, particularly in compressing and thus substantially reducing the volume of dirt of a fibroid type. Accordingly, premature degradation of the suction performance of a vacuum cleaner due to fibrous type dirt can be effectively prevented to thereby avoid the inconvenience of frequent removal of the dirt in the dirt collecting chamber 29.

After the preset time period(5 seconds), the Lo and Hi signals are applied to the terminals b and a of the motor driving circuit for the predetermined time(1.5 seconds). This allows the transistors Q4 to Q6 to be turned "ON" and the transistors Q1 to Q3 to be turned "OFF", thereby rotating the motor 40 in the reverse direction to return the shielding plate 38 to its initial position so as to open the first opening portion 34 constituting the first air suction passage 35 and to close the second opening portion 36 constituting the second air suction passage 37. At the end of the predetermined time(1.5 seconds) when the first opening portion 34 constituting the first air suction passage 35 is in an open state, the motor 40 is turned "OFF".

Under this condition, when the electric blower 12 is operated at a power level set by a user, the dirt entraining air sucked by the suction head 6 is drawn to the separation chamber 24 via the suction air inlet 25, the dirt conveying conduit 26 and the second communication path 27, as indicated by arrows in FIGS. 4 and 5.

At this time, since the first communication path 28 is provided at the position diagonally opposite to the second communication path 27 of the separation chamber 24, and the flow control guide 31 for guiding the suction air toward the first communication path 28 along the inner wall of the separation chamber 24 is installed at the portion of the dirt conveying conduit 26 close to the second communication path 27, the dirt containing air drawn to the separation chamber 24 from the second communication path 27 can form a spiral air stream directing toward the first communication path 28 along the inner wall of the separation chamber 24.

Owing to the spirally rotating air stream, centrifugal force is exerted on dirt included in the air stream, so that the dirt can be centrifugally separated therefrom. The dirt thus separated is accumulated in the dirt collecting chamber 29 via the first communication path 28 and dirt removed clean air is drawn to the electric blower 12 via the air suction filter 30 and the first air suction passage 35.

Further, since the shielding plate 38 is rotated by the motor 40 to close the first air suction passage 35 and open the second air suction passage 37 for the preset time period when the vacuum cleaner 100 starts to operate, it is possible to compress the dirt previously piled up in the dirt collecting chamber 29. As a result, premature degradation in the suction performance of the vacuum cleaner 100 due to a small amount of dirt can be effectively prevented. Moreover, since the need for removing dirt from the dirt collecting chamber 29 while operating the vacuum cleaner 100 becomes less likely, the efficiency of the vacuum cleaner 100 can be enhanced and at the same time, the inconvenience for frequent removal of the dirt from the dirt collecting chamber 29 can be avoided.

Also, while the electric blower 12 is operated at the maximum operation power level when the first air suction passage 35 is closed, the amount of air taken through the suction head 6 can be maximized, which in turn allows the dirt accumulated in the dirt collecting chamber 29 to be compressed significantly.

Furthermore, since the electric blower 12 is driven at a power level lower than the maximum operation power level while actuating the shielding plate 38, the shielding plate 38 is less affected by resistive force generated by the air stream pressure. Therefore, the conversion between the air suction passages 35 and 37 can be made smoothly.

In addition, since the shielding plate 38 is driven by the motor 40 during a certain period, the definite selection of the first or the second air suction passage 35 or 37 to be closed, i.e., the correct operation of the shielding plate 38 can be ensured.

Further, since the selection of an air suction passage 35 or 37 is simply made by the shielding plate 38 rotating in two opposite directions, the traveling stroke of the shielding plate 38 can be decreased and thus the installation of the shielding plate 38 may not hinder the scaling down of the main body 1.

Although the preferred embodiment of the invention has been described with respect to the shielding plate 38 driven to close the first air suction passage 35 for the preset time period when the vacuum cleaner 100 starts to operate, it is to be understood to those skilled in the art that such operation for compressing the dirt accumulated in the dirt collecting chamber 29 may be made to be achieved when the vacuum cleaner 100 stops to operate. In this case, the inventive cleaner 100 may be provided with, e.g., a secondary battery(not shown) installed therein for providing the power enabling the vacuum cleaner 100 to compress the dirt, even in a case where a power plug thereof is pulled out, e.g., accidentally to stop the cleaner 100.

Figure 10:
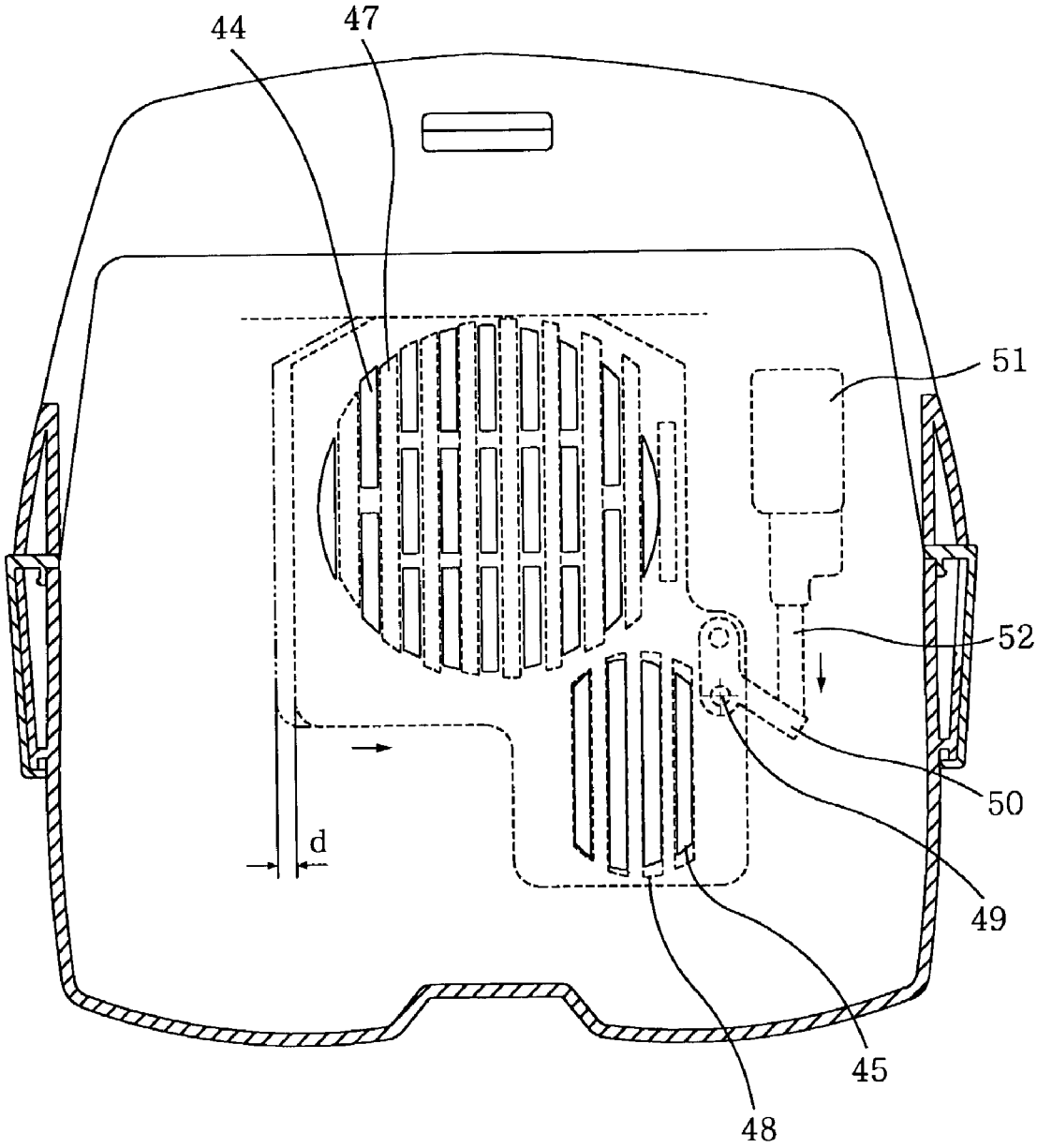
Figure 11:
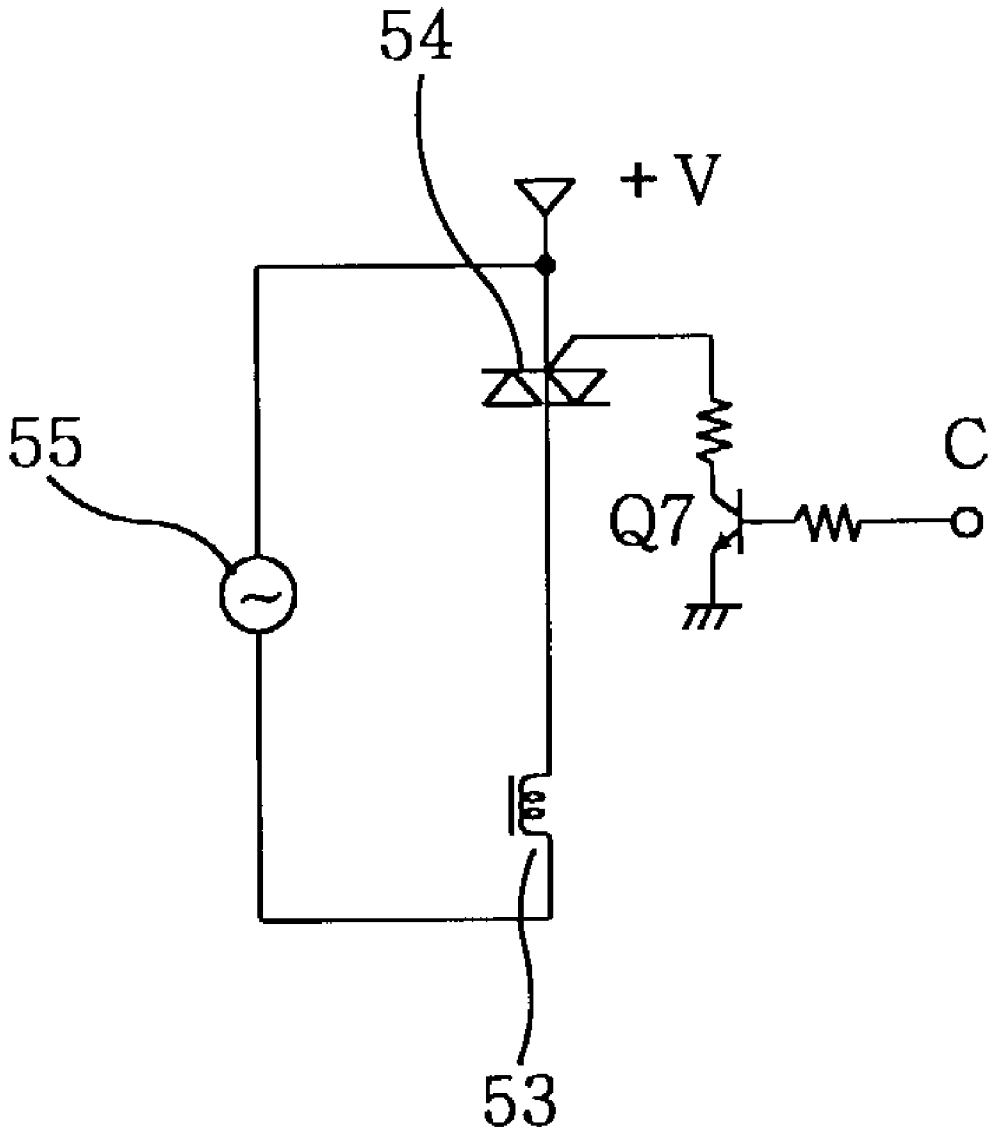
FIG. 11 exemplifies a driving circuit diagram of a solenoid for driving the shielding plate in accordance with the second preferred embodiment of the present invention.

A vacuum cleaner in accordance with a second preferred embodiment of the present invention will now be described with reference to FIGS. 9 to 11. The vacuum cleaner of the second preferred embodiment is similar to the first one excepting for a shielding mechanism and opening portions associated therewith.

Figure 9:
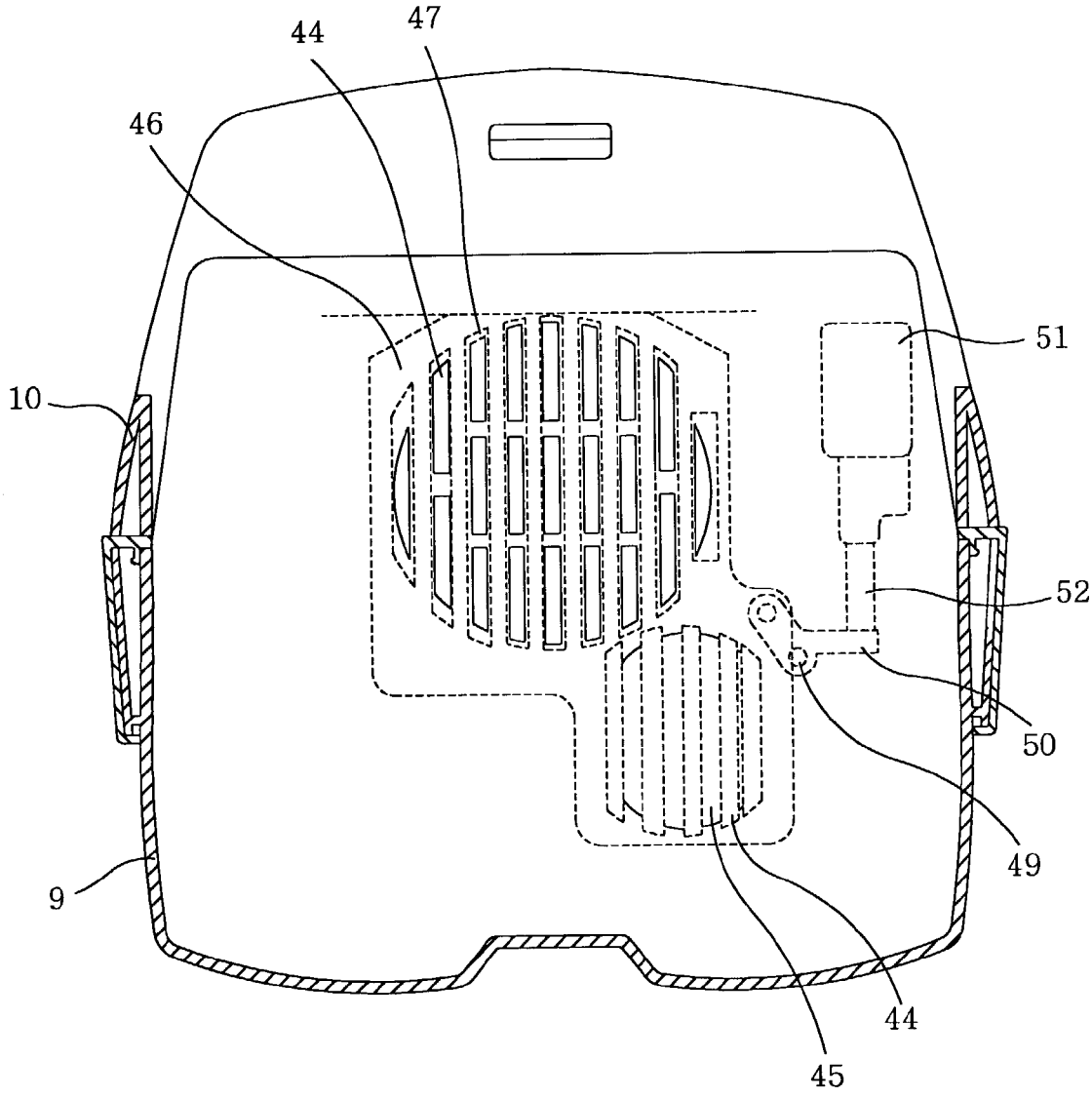
FIGS. 9 and 10 provide respective cross sectional views for illustrating an operation of a shielding plate in accordance with a second preferred embodiment of the present invention.

As shown in FIG. 9, the vacuum cleaner of the second preferred embodiment is provided with a first opening portion 44 constituting a first air suction passage(not shown) through which the air suction filter 30 (FIG. 1) is in air flow communication with the electric blower 12(FIG. 1); and a second opening portion 45 constituting a second air suction passage(not shown) through which the compression filter 33(FIG. 1) is in air flow communication with the electric blower 12. The first and the second opening portion 44 and 45 respectively have a first and a second set of slots.

Also provided is a shielding plate 46 for selectively blocking the first and the second opening portion 44 and 45. The shielding plate 46 has a first and a second counterpart opening portion 47 and 48 corresponding to the first and the second opening portion 44 and 45, respectively. The first and the second opening counterpart portion 47 and 48 respectively have a first and a second group of counterpart slots having shapes similar to those of their corresponding slots of the opening portions 44 and 45. The first and the second counterpart slots are configured in such a manner that when the slots of one of the counterpart opening portions 47 and 48 are located to be aligned with those of a corresponding opening portion 44 or 45, the slots of the other one of the counterpart opening portions 47 and 48 are misaligned from those of the remaining opening portion 45 or 44 by, e.g., a width of one slot, as shown in FIGS. 9 and 10. The shielding plate 46 is coupled to a coupling member 50 rotatably installed around a pivot 49 and can be shifted by the rotational movement of the coupling member 50 as much as a distance "d" as shown in FIG. 10.

A solenoid 51 actuates the coupling member 50 via linear motion of a plunger 52. As shown in FIG. 11, a coil 53 of the solenoid 51 is connected to an AC power source 55 via a bi-directional thyristor 54. If a logic high(Hi) signal is applied to an input terminal c, both of a transistor Q7 and the bi-directional thyristor 54 are turned "ON", to thereby induce a current through the coil 53 to allow the plunger 52 to be protruded and urge the shielding plate 46 to move by the distance "d" corresponding to the width of one slot as shown in FIG. 10. The parts of the vacuum cleaner other than the shielding mechanism described above in accordance with the second preferred embodiment are identical to those of the first preferred embodiment.

In operation, when the vacuum cleaner starts to operate, the electric blower 12 is activated at an operation power level lower than the maximum operation power level and, simultaneously, the Hi signal is inputted to the input terminal c of the solenoid driving circuit. Consequently, both of the transistor Q7 and the bi-directional thyristor 54 are turned "ON", thereby inducing a current to flow through the coil 53. Thus, the plunger 52 picks out and moves the shielding plate 46 by the distance "d" corresponding to the width of one slot, as shown in FIG. 10.

Resultantly, the slots of the first counterpart opening portion 47 and those of the first opening portion 44 are alternately disposed without being overlapped with each other, while the slots of the second counterpart opening portion 48 are aligned with those of the second opening portion 45. Therefore, the first opening portion 44 is blocked by the shielding plate 46 while the second opening portion 45 is opened. Under this condition, the electric blower 12 is operated at the maximum operation power level and, therefore, the suction air drawn through the suction air inlet 25 can be used in compressing the dirt accumulated in the dirt collecting chamber 29 via the path identical to that described in the first preferred embodiment.

After the preset time period(5 seconds), a Lo signal is inputted to the input terminal c. Therefore, the transistor Q7 and the bi-directional thyristor 54 are turned "OFF" to cut off the current through the coil 53, so that the plunger 52 is returned to its initial position; and, accordingly, the shielding plate 46 is returned to its initial position as shown in FIG. 9.

As a consequence, since the slots of the first counterpart opening portion 47 are overlapped with the slots of the first opening portion 44, the first opening portion 44 is opened; but since the slots of the second counterpart opening portion 48 are misaligned not to overlap with the slots of the second opening portion 45, the second opening portion 45 is blocked. Under this condition, while the electric blower 12 is in operation, the dirt containing air drawn from the suction air inlet 25 enters into the separation chamber 24 via the identical path as described in the first preferred embodiment.

Thereafter, the dirt containing air is revolved along the inner wall of the separation chamber 24 toward the first communication path 28 to form the cyclonic air flow. Owing to this cyclonic air flow, the dirt entrained in the suction air is centrifugally separated therefrom. Thus separated dirt is then accumulated in the dirt collecting chamber 29 and the remaining clean air is taken to the electric blower 12 via the air suction filter 30 and the first air suction passage having the first opening portion 44.

As described above, since the first and the second opening portion 44 and 45 can be selectively blocked by the shielding plate 46 driven by the solenoid 51, it is possible to centrifugally separate dirt from the suction air drawn through the suction head 6 for the collection thereof or compress thus collected dirt.

While the invention has been shown and described with respect to the preferred embodiments, it will be understood by those skilled in the art that various changes and modifications may be made without departing from the spirit and scope of the invention as defined in the following claims.

What is claimed is:

1. A vacuum cleaner comprising:

a main body having an electric blower for generating a suction air flow;

a dirt collecting case installed at an intake side of the electric blower, communicating with a suction head which draws dirt containing air into the main body; and a dirt compressor for reducing a volume of dirt accumulated in the dirt collecting case through the use of the suction air flow, wherein the dirt collecting case includes:

a separation chamber wherein dirt is centrifugally separated from the dirt containing air;

a first air intake member provided in the separation chamber and communicating with the electric blower;

a dirt collecting chamber in communication with the separation chamber arranged to accumulate the dirt separated in the separation chamber; and a second air intake member provided in the dirt collecting chamber and communicating with the electric blower;

wherein the dirt compressor guides the suction air flow toward the electric blower through the first or the second air intake member selectively to thereby compress the dirt accumulated in the dirt collecting case when the suction air flow is guided through the second air intake member.

2. The vacuum cleaner of claim 1, wherein the dirt compressor includes means for selectively opening a first and a second air suction passage, the first air intake member being in communication with the electric blower through the first air suction passage, and the second air intake member being in communication with the electric blower through the second air suction passage, wherein said means for selectively opening the air suction passages closes the first air suction passage and opens the second air suction passage to direct the suction air flow toward the electric blower via the separation chamber, the dirt collecting chamber, the second air intake member and the second air suction passage in that sequence to thereby compress the dirt accumulated in the dirt collecting chamber.

3. The vacuum cleaner of claim 2, wherein said means for selectively opening the air suction passages includes a shielding plate for selectively blocking a first opening portion constituting the first air suction passage and a second opening portion constituting the second air suction passage, and an actuator for moving the shielding plate to selectively open the air suction passages.

4. The vacuum cleaner of claim 3, further comprising an actuator driving circuit for closing the first air suction passage during a predetermined time period when starting the electric blower.

5. The vacuum cleaner of claim 4, further comprising means for operating the electric blower at a maximum operation power level for a predetermined period of time when the first air suction passage is closed.

6. The vacuum cleaner of claim 3, further comprising an actuator driving circuit for closing the first air suction passage for a predetermined time period when stopping the electric blower.

7. The vacuum cleaner of claim 6, further comprising means for operating the electric blower at a maximum operation power level for a predetermined period of time when the first air suction passage is closed.

8. The vacuum cleaner of claim 3, further comprising means for operating the electric blower at a power level lower than a maximum operation power level while the shielding plate is moved.

9. The vacuum cleaner of claim 8, wherein opening and blocking the first opening portion is achieved by rotating the shielding plate in a first and a second direction, the first direction being opposite to the second direction.

10. The vacuum cleaner of claim 3, wherein the actuator is a motor and the actuator is arranged to move the shielding plate for a preset time.

11. The vacuum cleaner of claim 3, wherein opening and blocking the first opening portion is achieved by rotating the shielding plate in a first and a second direction, the first direction being opposite to the second direction.

12. The vacuum cleaner of claim 3, wherein the actuator is a solenoid.

13. A vacuum cleaner comprising:

an electric blower for generating a suction air flow;

a dirt separating chamber for centrifugally separating dirt from dirt containing air carried by the suction air flow;

a dirt collecting chamber in communication with the separating chamber for accumulating the dirt separated by the dirt separating chamber; and means for guiding the suction air flow toward the electric blower through the dirt collecting chamber to thereby compress the dirt accumulated in the dirt collecting chamber, wherein the guiding means includes:

an air passage through which the dirt collecting chamber communicates with the electric blower; and a shutter which opens the air passage to compress the accumulated dirt.

14. The vacuum cleaner of claim 13, wherein the guiding means further includes a driving circuit which controls the shutter to open the air passage for a predetermined time period when starting or stopping the electric blower.

15. The vacuum cleaner of claim 14, further comprising means for controlling the electric blower to be operated at a maximum power level during the predetermined time period.

16. A vacuum cleaner comprising:

an electric blower for generating a suction air flow;

a dirt chamber including a dirt separating path for separating dirt from dirt containing air carried by the suction air flow and a dirt collecting path having a dirt collecting chamber for collecting the separated dirt therein; and a switching means for guiding the suction air flow toward the electric blower via the dirt separating path or the dirt collecting path selectively, wherein the collected dirt is compressed when the suction air flow is guided through the dirt collecting path.

17. The vacuum cleaner of claim 16, wherein the switching means includes:

a first opening through which the dirt separating path communicates with the electric blower;

a second opening through which the dirt collecting chamber communicates with the electric blower; and a shutter which opens the first opening and closes the second opening to separate the dirt from the dirt containing air, or closes the first opening and opens the second opening to compress the collected dirt.

18. The vacuum cleaner of claim 17, wherein the switching means further includes a driving circuit which controls the shutter to close the first opening and open the second opening for a predetermined time period when starting or stopping the electric blower.

19. The vacuum cleaner of claim 18, wherein the vacuum cleaner further comprises means for controlling the electric blower to be operated at a maximum power level during the predetermined time period.

20. The vacuum cleaner of claim 16, wherein the dirt separating path includes a dirt separating member which centrifugally separates the dirt from the dirt containing air.

* * * * *